US011286923B2

(12) United States Patent
Willoughby et al.

(10) Patent No.: US 11,286,923 B2
(45) Date of Patent: Mar. 29, 2022

(54) REDUCED PRESSURIZATION SHIFT WITHIN DIAPHRAGM PUMP CAVITY

(71) Applicant: Graco Minnesota Inc., Minneapolis, MN (US)

(72) Inventors: Jason J. Willoughby, Minneapolis, MN (US); David M. Behrens, Hopkins, MN (US)

(73) Assignee: GRACO MINNESOTA INC., Minneapolis, MN (US)

( * ) Notice: Subject to any disclaimer, the term of this patent is extended or adjusted under 35 U.S.C. 154(b) by 148 days.

(21) Appl. No.: 16/371,671

(22) Filed: Apr. 1, 2019

(65) Prior Publication Data

US 2019/0301443 A1 Oct. 3, 2019

Related U.S. Application Data

(60) Provisional application No. 62/651,552, filed on Apr. 2, 2018.

(51) Int. Cl.

| | |
|---|---|
| ***F04B 43/06*** | (2006.01) |
| ***F04B 45/04*** | (2006.01) |
| ***F04B 45/053*** | (2006.01) |
| ***F04B 53/10*** | (2006.01) |
| ***F04B 43/00*** | (2006.01) |

(Continued)

(52) U.S. Cl.

CPC ..... *F04B 43/06* (2013.01); *F04B 43/0081* (2013.01); *F04B 43/0736* (2013.01); *F04B 45/043* (2013.01); *F04B 45/0533* (2013.01); *F04B 45/0536* (2013.01); *F04B 53/06* (2013.01); *F04B 53/1002* (2013.01); *F04B 45/047* (2013.01)

(58) Field of Classification Search

CPC .... F04B 43/0081; F04B 43/06; F04B 43/073; F04B 43/0736; F04B 45/043; F04B 45/0533; F04B 45/0536; F04B 53/06; F04B 53/1002; F04B 51/00; F04B 45/047; F16K 1/14; F16K 15/044; F16K 15/183; F16K 31/22; Y10T 137/3099

USPC ..... 137/202

See application file for complete search history.

(56) References Cited

U.S. PATENT DOCUMENTS 3,131,638 A * 5/1964 Wilson ..... F04B 43/009 92/5 R 3,416,461 A 12/1968 McFarland (Continued)

FOREIGN PATENT DOCUMENTS

EP 0314994 A1 5/1989

OTHER PUBLICATIONS

McMaster-Carr catalog 114, p. 113, p. 145-147 (Year: 2008).*

(Continued)

*Primary Examiner* — Devon C Kramer
*Assistant Examiner* — Joseph S. Herrmann
(74) *Attorney, Agent, or Firm* — Kinney & Lange, P.A.

(57) ABSTRACT

A positive displacement pump includes a housing surrounding a drive chamber and a diaphragm compartment. A drive element is inside the drive chamber. A diaphragm is inside the diaphragm compartment and divides the diaphragm compartment into a fluid chamber and a cavity. A shaft connects the drive element and the diaphragm. A breather valve is fluidically connected to the cavity and is configured to allow air to exit the cavity. The cavity is fluidically disconnected from the drive chamber.

17 Claims, 9 Drawing Sheets

(51) Int. Cl.

| | |
|---|---|
| ***F04B 43/073*** | (2006.01) |
| ***F04B 53/06*** | (2006.01) |
| *F04B 45/047* | (2006.01) |

(56) References Cited

U.S. PATENT DOCUMENTS

| | | | | |
|---|---|---|---|---|
| 3,786,829 | A * | 1/1974 | Nardo | F16K 24/046 137/202 |
| 3,838,946 | A * | 10/1974 | Schall | F04B 9/135 417/395 |
| 5,386,843 | A * | 2/1995 | Church | B60K 15/03519 137/202 |
| 6,158,982 | A | 12/2000 | Kennedy et al. | |
| 8,123,500 | B2 * | 2/2012 | Juterbock | F04B 43/0736 417/395 |
| 8,313,313 | B2 * | 11/2012 | Juterbock | F04B 43/009 417/399 |
| 2009/0196771 | A1 | 8/2009 | Juterbock et al. | |
| 2015/0047717 | A1 * | 2/2015 | Orgill | F16K 24/046 137/202 |
| 2015/0226192 | A1 | 8/2015 | Hines et al. | |

OTHER PUBLICATIONS

Graco Minnesota Inc., Endura-Flo 4D150 and 4D350 Diaphragm Pump,40 pages, Minneapolis, MN.

First Chinese Office Action dated May 11, 2020, received for corresponding Chinese Application No. 201910264871.7, 24 pages.

Extended European Search Report dated Jun. 24, 2019, received for corresponding European Application No. 19166829.2.

First Chinese Office Action dated Dec. 15, 2020, received for corresponding Chinese Application No. 201910264871.7, 9 pages.

* cited by examiner

REDUCED PRESSURIZATION SHIFT WITHIN DIAPHRAGM PUMP CAVITY

CROSS-REFERENCE TO RELATED APPLICATION(S)

This application claims the benefit of U.S. Provisional Application No. 62/651,552 filed Apr. 2, 2018 for "REDUCED PRESSURIZATION SHIFT WITHIN DIAPHRAGM PUMP CAVITY," by Jason J. Willoughby and David M. Behrens, the disclosures of which are hereby incorporated in their entirety.

BACKGROUND

This disclosure relates generally to positive displacement pumps and more particularly to positive displacement pumps with diaphragms.

Positive displacement pumps can be air driven, electrically driven, or hydraulically driven. Air driven double displacement pumps typically employ diaphragms to move a working fluid, such as paint. In an air driven double displacement pump, two diaphragms are joined by a shaft, and compressed air performs work in the pump. Compressed air is applied to one of two diaphragm chambers associated with the respective diaphragms. When compressed air is applied to the first diaphragm chamber, the first diaphragm is deflected into the first fluid cavity, which discharges the working fluid from that fluid cavity. Simultaneously, the first diaphragm pulls the shaft, which is connected to the second diaphragm, drawing the second diaphragm in and pulling working fluid into the second fluid cavity. Delivery of compressed air is controlled by an air valve, and the air valve is usually actuated mechanically by the diaphragms or a center piston connected to the diaphragms. Thus, one diaphragm is pushed out until it causes the actuator to hit a pilot valve that toggles the air valve. Toggling the air valve exhausts the compressed air from the first diaphragm chamber to the atmosphere and introduces fresh compressed air to the second diaphragm chamber, thus causing a reciprocating movement of the respective diaphragms. In some embodiments, a piston is included on the shaft to increase the pneumatic working area and pumping pressure for the pump.

Over time, the diaphragms can wear and will eventually fail. When a diaphragm punctures, working fluid passes through the diaphragm chamber and enters the pneumatic passages and valves of the pump and exits out the exhaust of the air valve. In such an event, the air driven double displacement pump must be completely disassembled and cleaned, which is a relatively time-consuming and expensive process.

SUMMARY

In one aspect of the disclosure, a positive displacement pump includes a housing surrounding a drive chamber and a diaphragm compartment. A drive element is inside the drive chamber. A diaphragm is inside the diaphragm compartment and divides the diaphragm compartment into a fluid chamber and a cavity. A shaft connects the drive element and the diaphragm. A breather valve is fluidically connected to the cavity and is configured to allow air to exit the cavity. The cavity is fluidically disconnected from the drive chamber.

In another aspect of the disclosure, a dual diaphragm pump includes a housing surrounding an air motor chamber, a first diaphragm compartment, and a second diaphragm compartment. A piston is disposed inside the air motor chamber. A first diaphragm is inside the first diaphragm compartment and divides the first diaphragm compartment into a first fluid chamber and a first air cavity. A second diaphragm is inside the second diaphragm compartment and divides the second diaphragm compartment into a second fluid chamber and a second air cavity. A first shaft connects the piston and the first diaphragm. A second shaft is connected to the piston opposite the first shaft and connects the piston and the second diaphragm. A breather valve is fluidically connected to the first air cavity and is configured to allow air to exit the first air cavity. The first air cavity and the second air cavity are fluidically disconnected from the air motor chamber.

Persons of ordinary skill in the art will recognize that other aspects and embodiments of the present invention are possible in view of the entirety of the present disclosure, including the accompanying figures.

Figure 1:
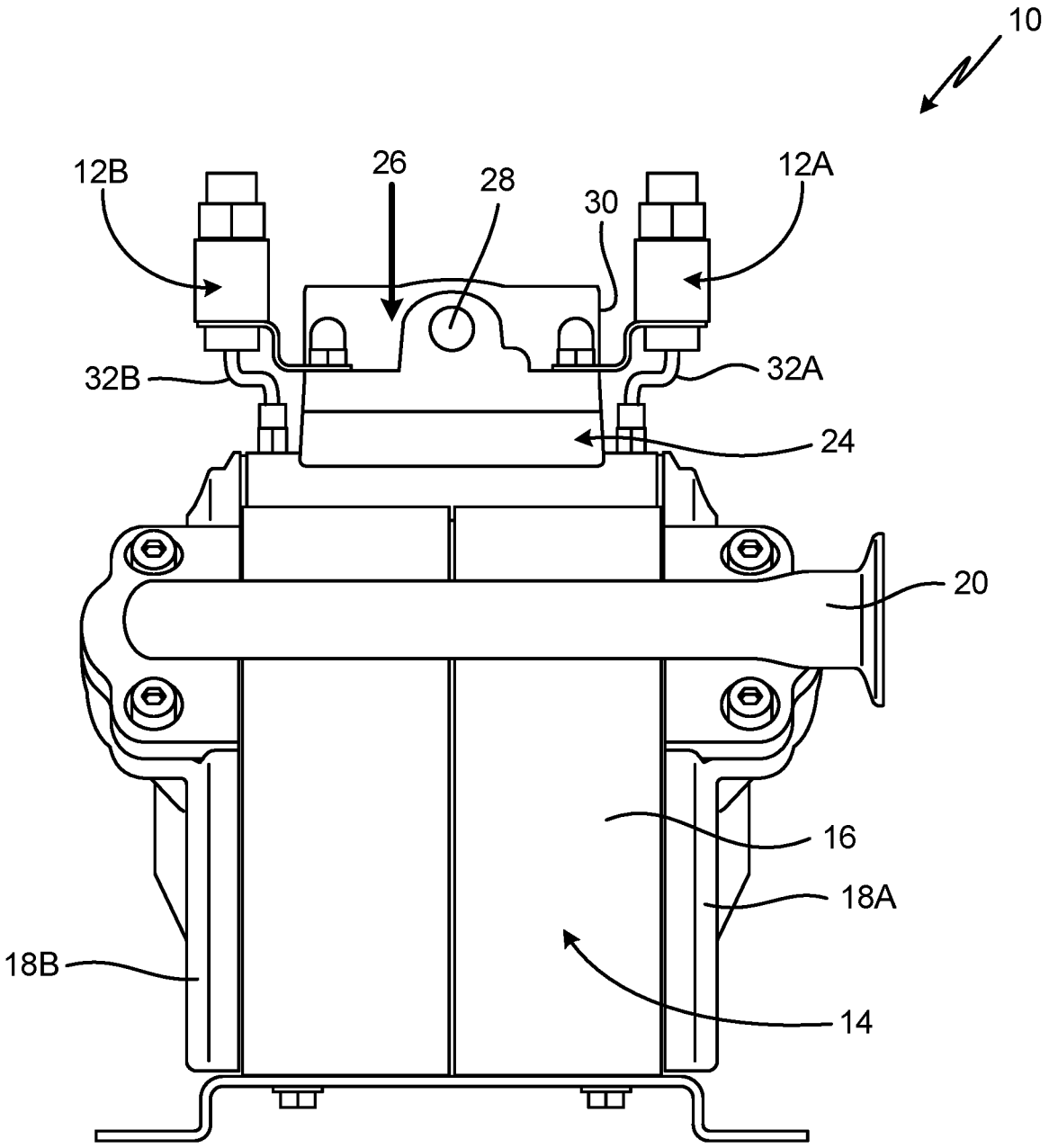
FIG. 1 is a front elevation view of a dual diaphragm positive displacement pump with a first breather valve and a second breather valve.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

This disclosure relates to a positive displacement pump with a first diaphragm and a second diaphragm for moving a working fluid through the positive displacement pump. The first diaphragm and the second diaphragm are actuated by an air motor piston that is housed inside an air motor chamber. The air motor piston and the air motor chamber are fluidically disconnected from the first diaphragm and the second diaphragm such that the working fluid is unable to reach the air motor chamber should the first diaphragm or the second diaphragm rupture. In the event that one of the diaphragms rupture, only a portion of the positive displacement pump has to be disassembled and cleaned since the air motor chamber is fluidically isolated from the diaphragms. Cavities behind the first diaphragm and the second diaphragm are vented by at least one breather valve. The breather valve allows air to escape the cavities when air pressure builds inside of the cavities, but is configured to stop working fluid from leaking out of the pump should one of the diaphragms rupture. Allowing the air to escape the cavities prevents pressure from building behind the diaphragms and stressing the diaphragms, thereby extending the working life of the diaphragms. The positive displacement pump and breather valve are discussed below with reference to the figures.

Figure 2B:
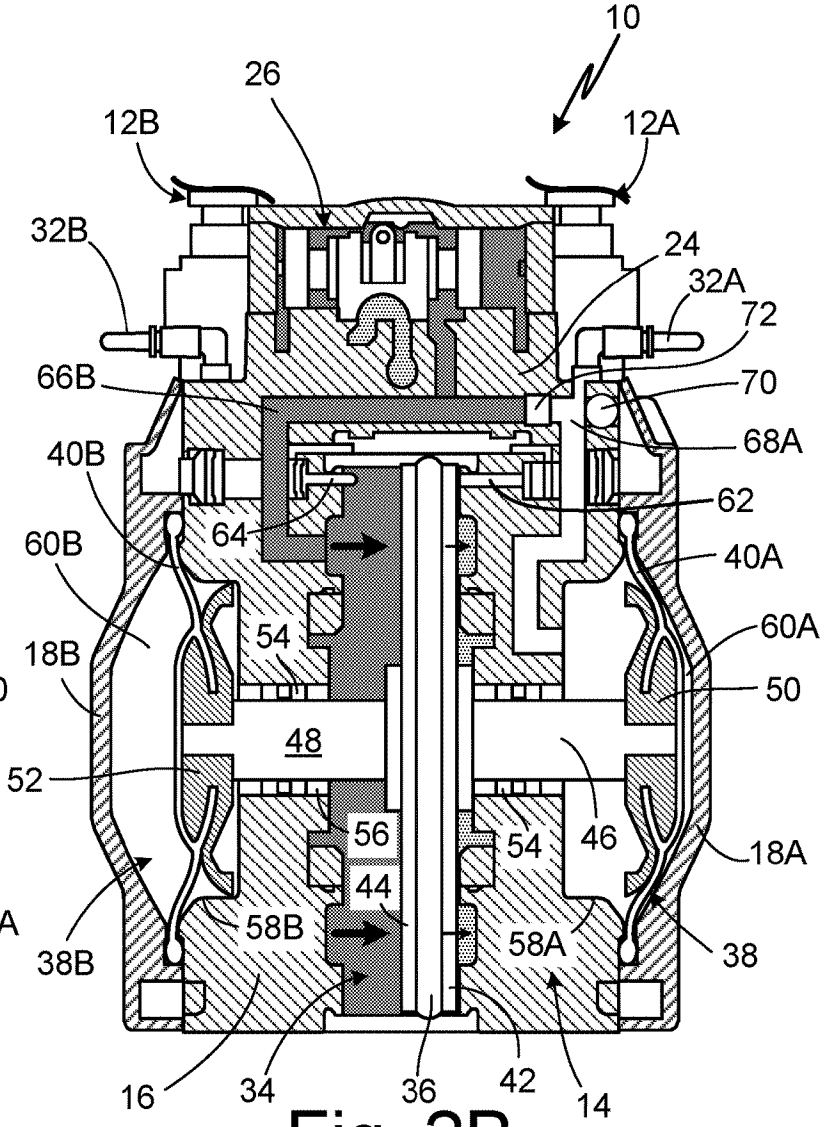
FIG. 2B is another front cross-sectional view of the dual diaphragm positive displacement pump with the air motor piston moving in the first direction.
Figure 2A:
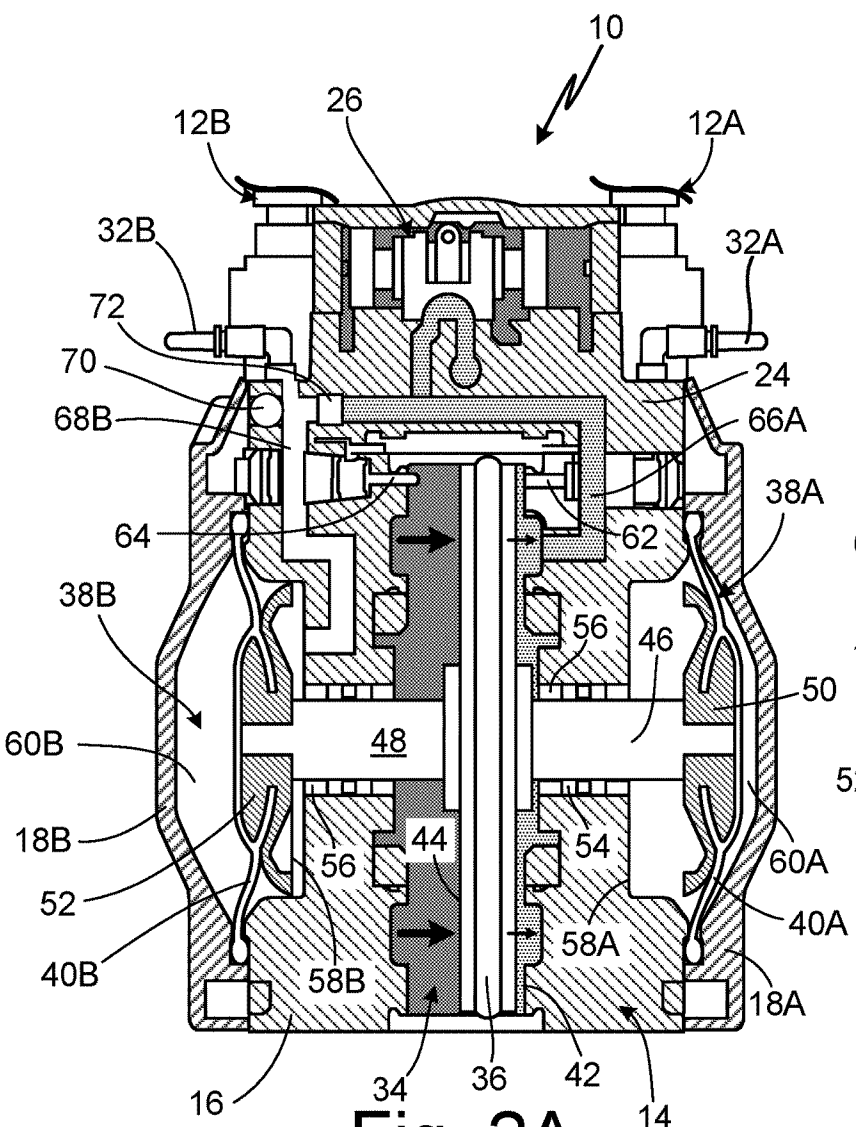
FIG. 2A is a front cross-sectional view of the dual diaphragm positive displacement pump with an air motor piston moving in a first direction.
Figure 2C:
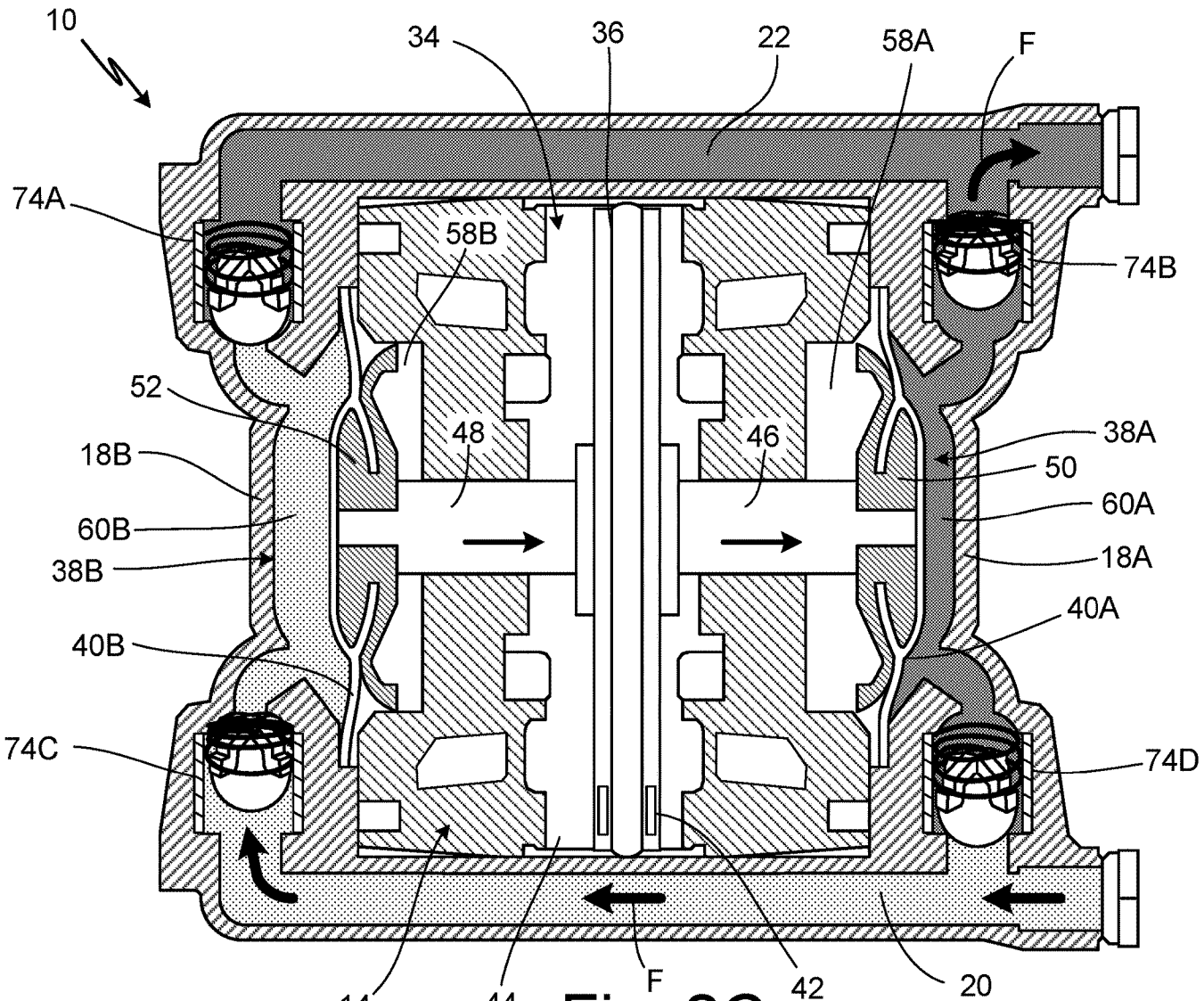
FIG. 2C is a top cross-sectional view of the dual diaphragm positive displacement pump with the air motor piston moving in the first direction.

FIGS. 1-2C will be discussed concurrently. FIG. 1 is a front elevation view of positive displacement pump 10 with first breather valve 12A and second breather valve 12B. FIGS. 2A and 2B are both front cross-sectional views of positive displacement pump 10 taken at different positions so as to show all of the passages within positive displacement pump 10. FIG. 2C is a top cross-sectional view of positive displacement pump 10.

As shown in FIGS. 1-2C, positive displacement pump 10 includes first breather valve 12A, second breather valve 12B, and housing 14. Housing 14 includes main body 16, first fluid cover 18A, second fluid cover 18B, fluid inlet 20, fluid outlet 22 (shown in FIG. 2C), and air manifold 24 that houses air valve 26 and provides air inlet 28 and air outlet 30. Positive displacement pump 10 also includes first external line 32A and second external line 32B. As shown best in FIGS. 2A and 2B, positive displacement pump 10 also includes air motor chamber 34, air motor piston 36, first diaphragm compartment 38A, second diaphragm compartment 38B, first diaphragm 40A, and second diaphragm 40B. Air motor piston 36 includes first side 42, second side 44. Positive displacement pump 10 also includes first shaft 46, second shaft 48, first plate 50, second plate 52, seals 54, and bearings 56. First diaphragm compartment 38A includes first air cavity 58A and first fluid chamber 60A. Second diaphragm compartment 38B includes second air cavity 58B and second fluid chamber 60B. Air valve 26 includes first pilot valve 62 and second pilot valve 64. Positive displacement pump 10 also includes first air passage 66A (shown in FIG. 2A), second air passage 66B (shown in FIG. 2B), first vent passage 68A (shown in FIG. 2B), second vent passage 68B (shown in FIG. 2A), spherical plugs 70, and cylindrical plugs 72. As shown in FIG. 2C, positive displacement pump also includes check valves 74A-74D.

Air motor chamber 34 is formed in main body 16 of housing 14 and is generally centered in main body 16. Air manifold 24 is connected to a top of main body 16 and covers air motor chamber 34 such that air motor chamber 34 is surrounded and enclosed by main body 16 and air manifold 24 of housing 14. First diaphragm compartment 38A is formed and enclosed in housing 14 by main body 16 and first fluid cover 18A. Second diaphragm compartment 38A is formed and enclosed in housing 14 by main body 16 and second fluid cover 18B. First fluid cover 18A and second fluid cover 18B can both be removably connected to main body 16 to provide access to first diaphragm compartment 38A and second diaphragm compartment 38B for maintenance and repair purposes. Air motor chamber 34 is positioned physically in housing 14 between first diaphragm compartment 38A and second diaphragm compartment 38B.

Air motor piston 36 is disposed inside air motor chamber 34 and is sized to slide and actuate back and forth inside air motor chamber 34. Air motor piston 36 is a cylinder that extends axially from first side 42 to second side 44. First diaphragm 40A is disposed inside first diaphragm compartment 38A. First diaphragm 40A divides first diaphragm compartment 38A into first fluid chamber 60A and first air cavity 58A. First fluid chamber 60A is disposed between first diaphragm 40A and first fluid cover 18A. First air cavity 58A is disposed between first diaphragm 40A and main body 16 of housing 14. Second diaphragm 40B is disposed inside second diaphragm compartment 38B. Second diaphragm 40B divides second diaphragm compartment 38B into second fluid chamber 60B and second air cavity 58B. Second fluid chamber 60B is disposed between second diaphragm 40B and second fluid cover 18B. Second air cavity 58B is disposed between second diaphragm 40B and main body 16 of housing 14.

First shaft 46 is connected to first side 42 of air motor piston 36 and extends through housing 14 and into first air cavity 58A. First plate 50 is disposed inside first air cavity 58A and connects first shaft 46 to first diaphragm 40A. Second shaft 48 is connected to second side 44 of air motor piston 36 opposite first shaft 46. Second shaft 48 extends from second side 44 through housing 14 and into second air cavity 58B. Second plate 52 is disposed inside second air cavity 58B and connects second shaft 48 to second diaphragm 40B. Bearings 56 are disposed around first shaft 46 and second shaft 48 and between housing 14 and first and second shafts 46, 48 to reduce friction between housing 14 and first and second shafts 46, 48. Seals 54 are disposed between housing 14 and first and second shafts 46, 48 to prevent air or fluid from traveling between air motor chamber 34 and first and second air cavities 58A, 58B along first shaft 46 and second shaft 48.

Air valve 26 is housed inside air manifold 24 of housing 14. First air passage 66A (shown in FIG. 2A) is formed in main body 16 and air manifold 24 of housing 14 and fluidically connects air valve 26 with first side 42 of air motor piston 36 inside air motor chamber 34. Second air passage 66B (shown in FIG. 2B) is formed in main body 16 and air manifold 24 of housing 14 and fluidically connects air valve 26 with second side 44 of air motor piston 36 inside air motor chamber 34. Air valve 26 is configured to alternately connect first side 42 and second side 44 of air motor piston 36 with air inlet 28 and air outlet 30, both of which are shown in FIG. 1. First pilot valve 62 of air valve 26 extends into air motor chamber 34 opposite first side 42 of air motor piston 36. Second pilot valve 64 of air valve 26 extends into air motor chamber 34 opposite second side 44 of air motor piston 36. First pilot valve 62 and second pilot valve 64 are configured to toggle air valve 26 when air motor piston 36 comes into contact with first pilot valve 62 or second pilot valve 64. Toggling air valve 26 causes air valve 26 to switch which of first side 42 and second side 44 is fluidically connected with air inlet 28 and which of first side 42 and second side 44 is fluidically connected to air outlet 30.

First vent passage 68A (shown in FIG. 2B) is formed in main body 16 and air manifold 24 of housing 14 and fluidically connects first air cavity 58A to first external line 32A outside of housing 14. First external line 32A fluidically connects first vent passage 68A with first breather valve 12A (shown best in FIG. 1). First breather valve 12A is configured to allow air to exit first air cavity 58A when the air pressure inside first air cavity 58A exceeds atmospheric pressure. In the event first diaphragm 40A should rupture, first breather valve 12A is also configured to stop a working fluid from flowing out of positive displacement pump 10 via first air cavity 58A and first vent passage 68A. First air cavity 58A and first vent passage 68A are fluidically disconnected from air motor chamber 34 and air valve 26. As shown in FIG. 2B, cylindrical plug 72 separates first vent passage 68A from second air passage 66B, thereby preventing gas and liquid from traveling from first air cavity 58A to air motor chamber 34 and air valve 26, and vice versa. In the event first diaphragm 40A should rupture, cylindrical plug 72 stops working fluid from entering and contaminating air motor chamber 34 and air valve 26. Spherical plug 70 is inserted into a hole in air manifold 24 that was used to initially form first vent passage 68A and second air passage 66B.

Second vent passage 68B (shown in FIG. 2A) is formed in main body 16 and air manifold 24 of housing 14 and fluidically connects second air cavity 58B to second external line 32B outside of housing 14. Second external line 32B fluidically connects second vent passage 68B with second breather valve 12B (shown best in FIG. 1). Similar to first breather valve 12A, second breather valve 12B is configured to allow air to exit second air cavity 58B when the air pressure inside second air cavity 58B exceeds atmospheric pressure. In the event second diaphragm 40B should rupture, second breather valve 12B is also configured to stop a working fluid from flowing out of positive displacement pump 10 via second air cavity 58B and second vent passage 68B. Second air cavity 58B and second vent passage 68B are fluidically disconnected from air motor chamber 34 and air valve 26. As shown in FIG. 2A, another cylindrical plug 72 separates second vent passage 68B from first air passage 66A, thereby preventing gas and liquid from traveling from second air cavity 58B to air motor chamber 34 and air valve 26, and vice versa. In the event second diaphragm 40B should rupture, cylindrical plug 72 stops working fluid from entering and contaminating air motor chamber 34 and air valve 26. Spherical plug 70 is inserted into a hole in air manifold 24 that was used to initially form second vent passage 68B and first air passage 66A.

As shown in FIG. 2C, fluid inlet 20 is formed in housing 14 and is fluidically connected to both first fluid chamber 60A and second fluid chamber 60B by check valve 74A and check valve 74B respectively. Fluid outlet 22 is also formed in housing 14 and is fluidically connected to both first fluid chamber 60A and second fluid chamber 60B by check valve 74C and check valve 74D respectively.

During operation, positive displacement pump 10 is actuated by compressed air that is fed through air inlet 28. In the embodiments of FIGS. 2A-2C, air valve 26 is in a first position that fluidically connects aid inlet 28 with second air passage 66B and second side 44 of air motor piston 36. In the first position, air valve 26 also connects first air passage 66A and first side 44 of air motor piston 36 with air outlet 30. Thus, as compressed air enters air inlet 28, air valve 26 directs the compressed air to second side 44 of air motor piston 36, which causes air motor piston 36 to move to the right, as indicated by the arrows in FIGS. 2A-2C. As air motor piston 36 moves to the right, the air on first side 42 of air motor piston 36 is pushed out of air motor chamber 34 and out air outlet 30 via first air passage 66A. Also, as air motor piston 36 moves to the right, air motor piston 36 pulls on second diaphragm 40B, causing second fluid chamber 60B to expand and second air cavity 58B to contract. The expansion of second fluid chamber 60B causes check valve 74A to close and check valve 74C to open, which allows working fluid F, such as paint, to enter second fluid chamber 60B from fluid inlet 20 and fill second fluid chamber 60B as second fluid chamber 60B expands.

As air motor piston 36 moves to the right, air motor piston 36 also pushes first diaphragm 40A toward first fluid cover 18A, which compresses and shrinks first fluid chamber 60A while expanding first air cavity 58A. As shown in FIG. 2C, as air motor piston 36 pushes on first diaphragm 40A, check valve 74B is pushed open to allow the working fluid F in first fluid chamber 60A to flow into fluid outlet 22, while check valve 74D is pushed shut to prevent the working fluid F in first fluid chamber 60A from reentering fluid inlet 20. Once air motor piston 36 moves completely to the right, first side 42 of air motor piston 36 contacts first pilot valve 62 of air valve 26. In response to the contact, first pilot valve 62 toggles air valve 26 to a second position so that first side 42 of air motor piston 36 is in fluidic communication with air inlet 28, and second side 44 of air motor piston 36 is in fluidic communication with air outlet 30, thereby causing air motor piston 36 to travel to the left, as disclosed in FIGS. 3A-3C.

Figure 3B:
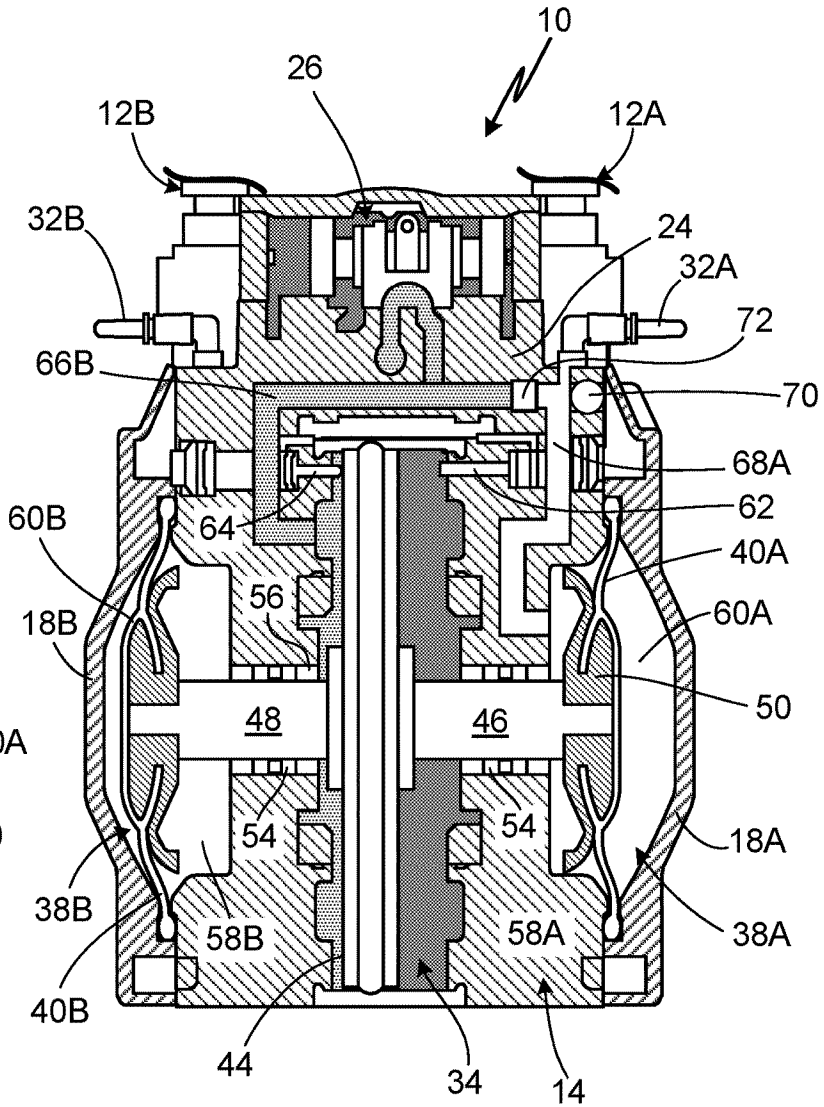
FIG. 3B is another front cross-sectional view of the dual diaphragm positive displacement pump with the air motor piston moving in the second direction.
Figure 3A:
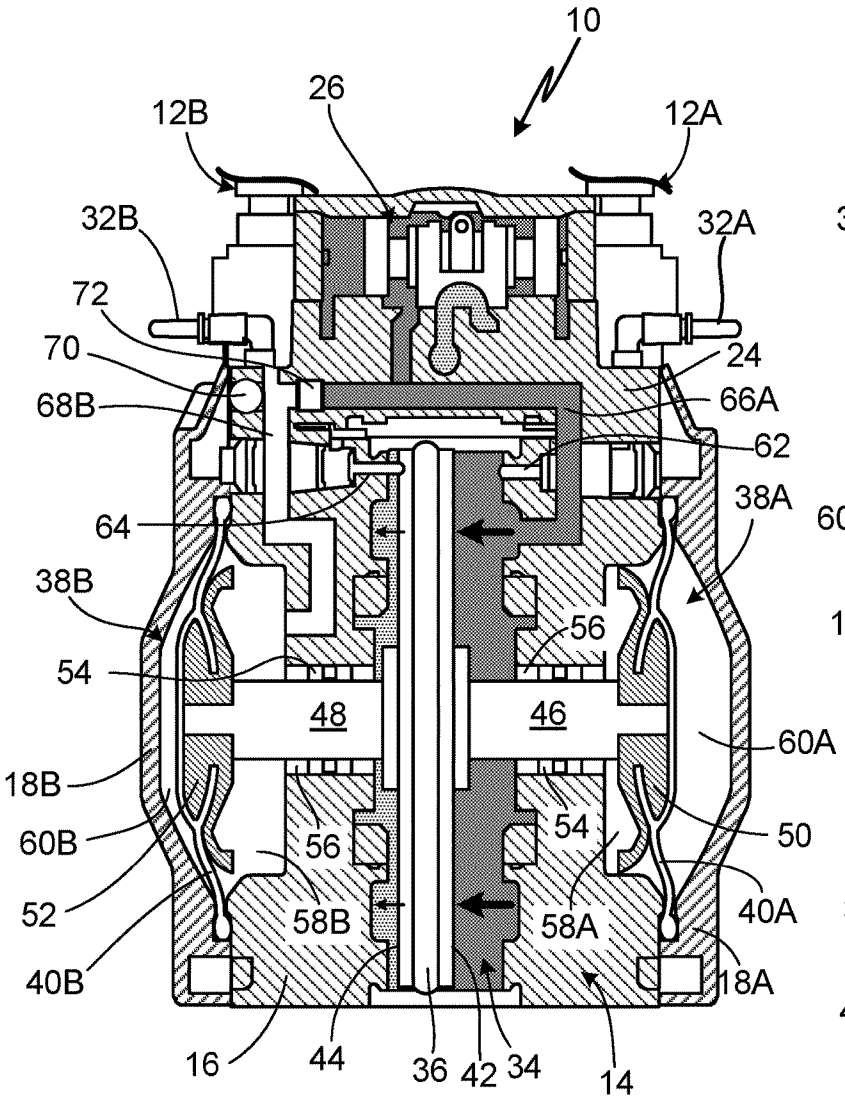
FIG. 3A is a front cross-sectional view of the dual diaphragm positive displacement pump with the air motor piston moving in a second direction.
Figure 3C:
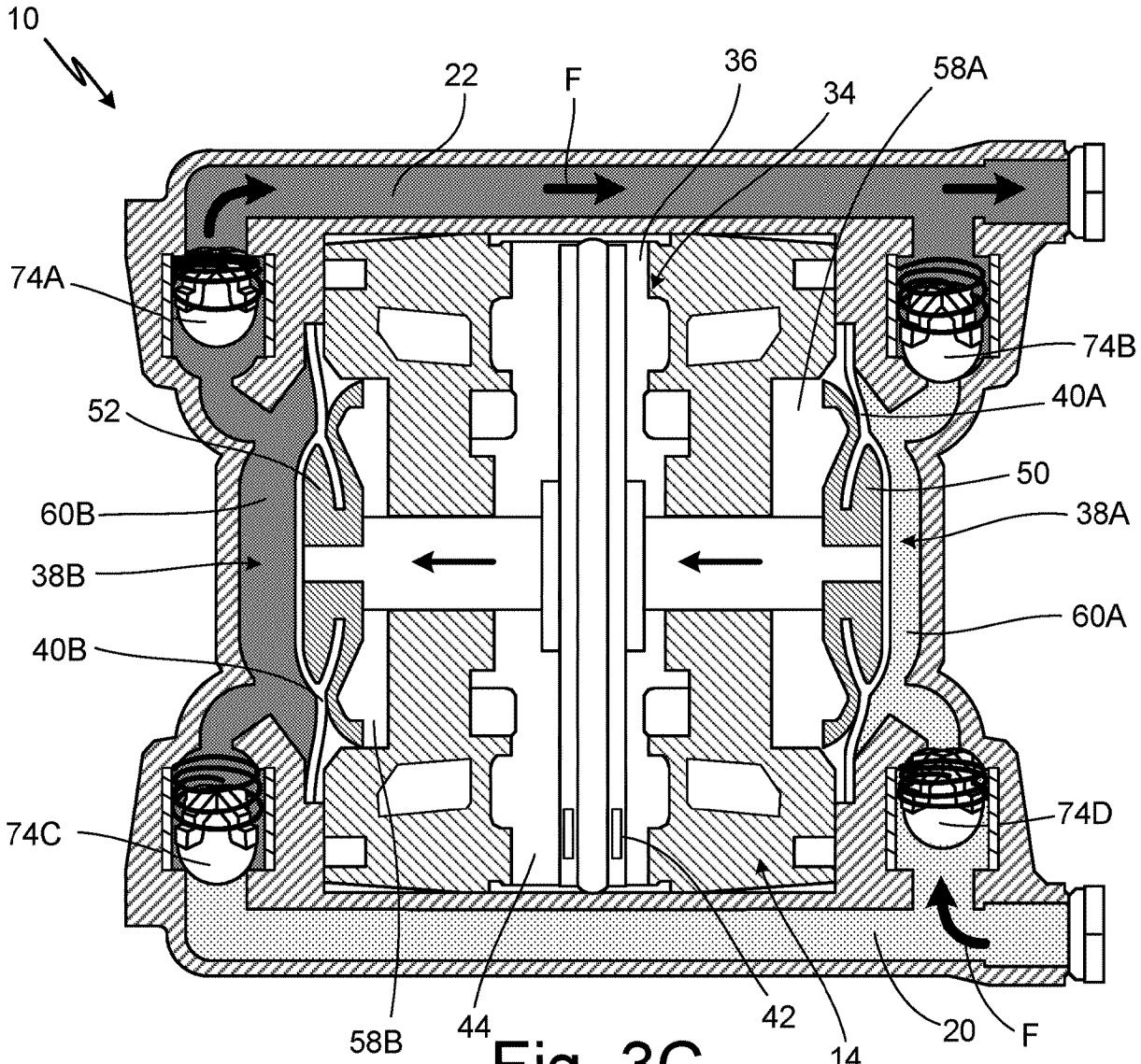
FIG. 3C is a top cross-sectional view of the dual diaphragm positive displacement pump with the air motor piston moving in the second direction.

FIGS. 3A-3C will be discussed concurrently. FIGS. 3A and 3B are both front cross-sectional views of positive displacement pump 10 taken at different positions so as to show all of the passages within positive displacement pump 10. FIG. 2C is a top cross-sectional view of positive displacement pump 10. In FIGS. 3A-3C, air valve is in a second position that fluidically connects first side 42 of air motor piston 36 with air inlet 28. In the second position, air valve 26 also fluidically connects second side 44 of air motor piston 36 with air outlet 30. As compressed air pushes against first side 42 of air motor piston 36, air motor piston 36 translates to the left as indicated by the arrows in FIGS. 3A-3C. As air motor piston 36

As air motor piston 36 moves to the left, the air on second side 44 of air motor piston 36 is pushed out of air motor chamber 34 and out air outlet 30 via second air passage 66A. Also, as air motor piston 36 moves to the left, air motor piston 36 pulls on first diaphragm 40A, causing first fluid chamber 60A to expand and first air cavity 58A to contract. The expansion of first fluid chamber 60A causes check valve 74B to close and check valve 74D to open, which allows working fluid F, such as paint, to enter first fluid chamber 60A from fluid inlet 20 and fill first fluid chamber 60A as second fluid chamber 60A expands.

As air motor piston 36 moves to the left, air motor piston 36 also pushes second diaphragm 40B toward second fluid cover 18B, which compresses and shrinks second fluid chamber 60B while expanding second air cavity 58B. As shown in FIG. 2C, as air motor piston 36 pushes on second diaphragm 40B, check valve 74A is pushed open to allow the working fluid F in second fluid chamber 60B to flow into fluid outlet 22, while check valve 74C is pushed shut to prevent the working fluid F in second fluid chamber 60B from reentering fluid inlet 20. Once air motor piston 36 moves completely to the left, second side 44 of air motor piston 36 contacts second pilot valve 64 of air valve 26. In response to the contact, second pilot valve 64 toggles air valve 26 so that second side 44 of air motor piston 36 is in fluidic communication with air inlet 28 once more, and first side 42 of air motor piston 36 is again in fluidic communication with air outlet 30, thereby causing air motor piston 36 to travel to the right again for another cycle. The motion of air motor piston 36, first diaphragm 40A, and second diaphragm 40B is repeated continuously as described to move working fluid F through positive displacement pump 10.

As air motor piston 36 pulls and pushes on first diaphragm 40A and second diaphragm 40B, first breather valve 12A and second breather valve 12B allow any buildup in air pressure inside first air cavity 58A and second air cavity 58B to be vented to atmosphere. Keeping first air cavity 58A and second air cavity 58B at substantially atmospheric pressure prolongs the working life of first diaphragm 40A and second diaphragm 40B in comparison to prior art displacement pumps. Unlike prior art displacement pumps where pressurized air is applied to diaphragms to actuate the diaphragms, no pressurized air is applied to first diaphragm 40A and second diaphragm 40B. Removing the application of pressurized air on first diaphragm 40A and second diaphragm 40B reduces the amount of strain and loading experienced by first diaphragm 40A and second diaphragm 40B. This reduction in strain and loading allows first diaphragm 40A and second diaphragm 40B to perform more cycles before wearing out and rupturing. Rupturing of first diaphragm 40A and/or second diaphragm is discussed below with reference to FIGS. 4A and 4B.

Figure 4A:
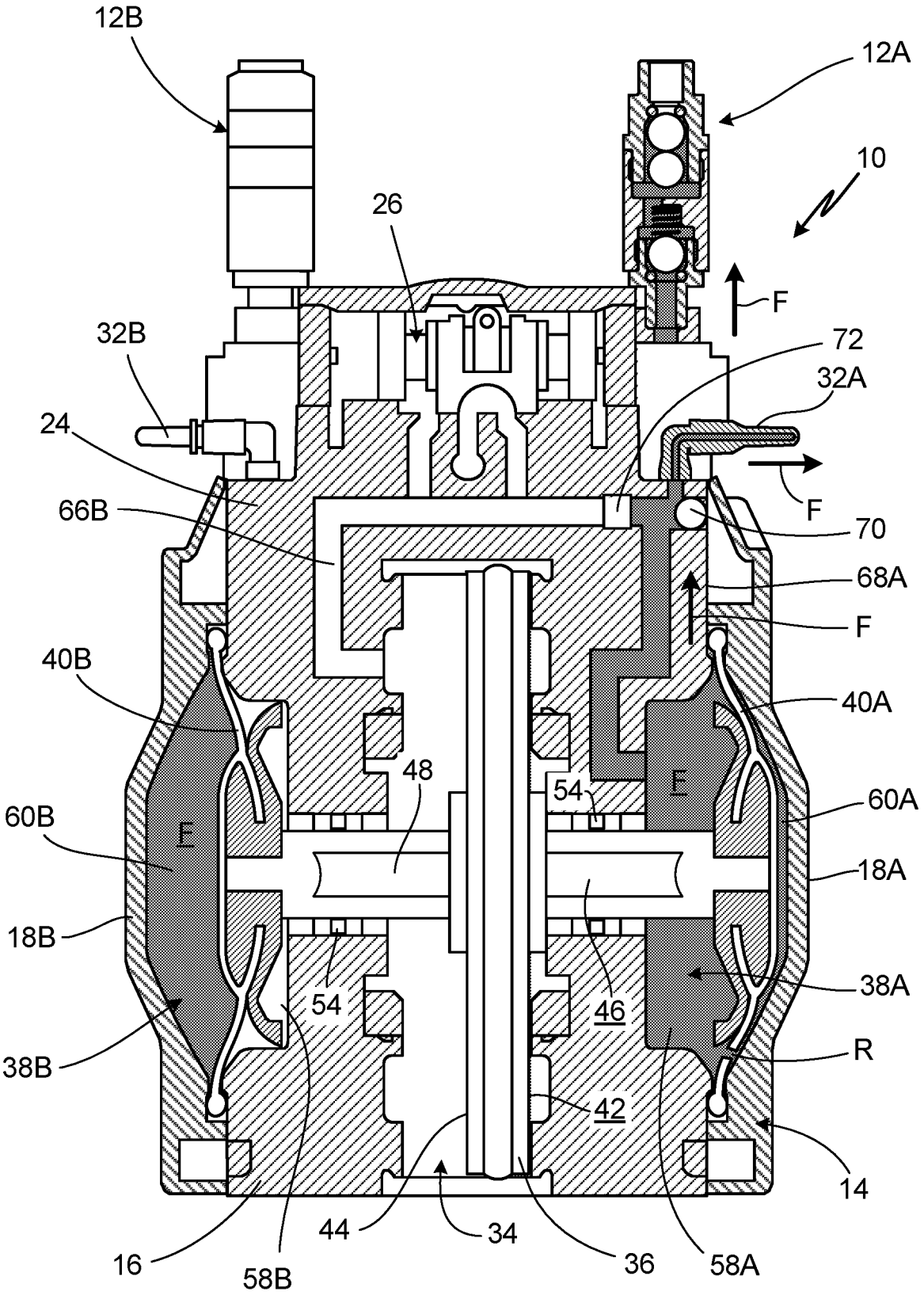
FIG. 4A is a front cross-sectional view of the dual diaphragm positive displacement pump with a ruptured diaphragm.
Figure 4B:
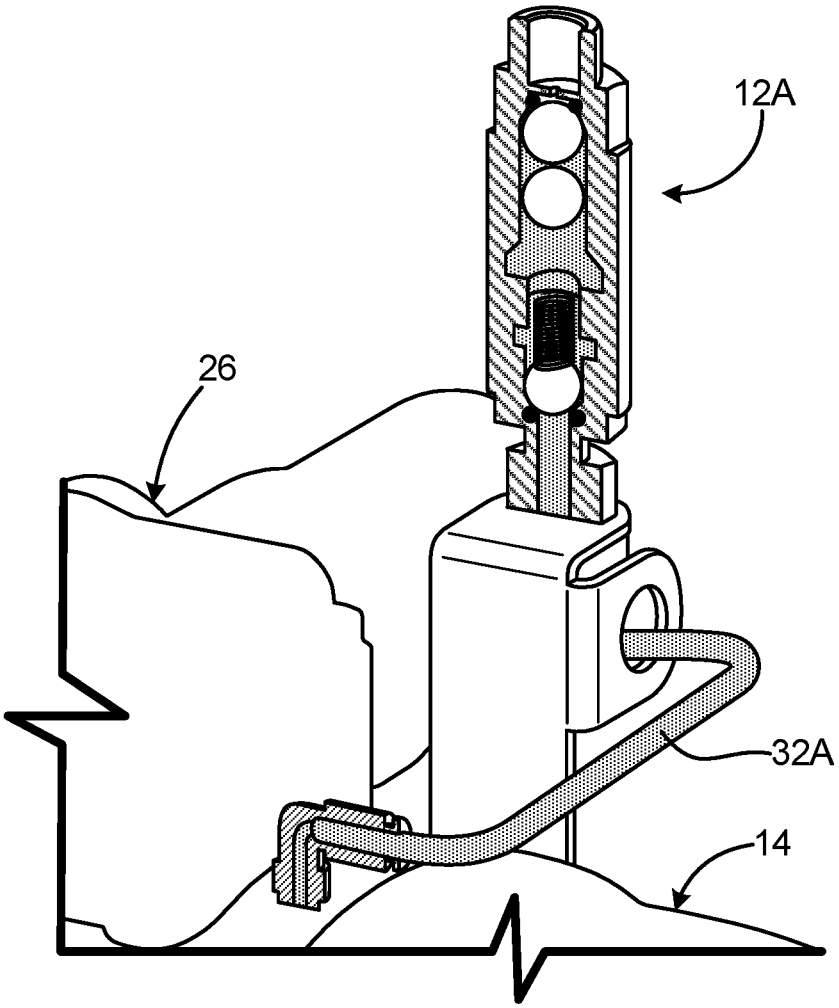
FIG. 4B is a cross-sectional view of the first breather valve from FIG. 4A.

FIG. 4A is a front cross-sectional view of positive displacement pump 10 with a rupture R in first diaphragm 40A. FIG. 4B is a cross-sectional view of first breather valve 12A after rupture R in first diaphragm 40A. As shown in FIGS. 4A and 4B, should first diaphragm 40A or second diaphragm 40B rupture, working fluid F does not enter air motor chamber 34 or air valve 26. Rather, the working fluid F is confined to the respective air cavity 58, fluid chamber 60, vent passage 68, external line 32, and breather valve 12 of the side of the ruptured diaphragm 40. In the embodiment of FIG. 4A, rupture R has formed in first diaphragm 40A. Due to rupture R, working fluid F has entered first air cavity 58A, traveled up first vent passage 68A, entered first external line 32A, entered first breather valve 12A, and is stopped inside first breather valve 12A. First external line 32A and second external line 32B can both be transparent tubes so that rupture R can be detected by visually inspecting first external line 32A and/or second external line 32B for the presence of working fluid F in those lines 32A, 32B.

To repair positive displacement pump 10 in FIGS. 4A and 4B, first fluid cover 18 is removed, first diaphragm 40A with rupture R is removed, and first breather valve 12A is removed. Next, first diaphragm compartment 38A, first vent passage 68A, and first external line 32A are flushed and cleaned. A new first diaphragm 40A is installed in first diaphragm compartment 38A and first fluid cover 18 is reattached to main body 16 of housing 14. First breather valve 12A is disassembled, cleaned, reassembled, and reattached to housing 14, or a new breather valve 12A is attached to housing 14. Once first breather valve 12A is connected back onto positive displacement pump 10, positive displacement pump is ready for continued service. First breather valve 12A and second breather valve 12A are discussed in detail below with reference to FIG. 5.

Figure 5:
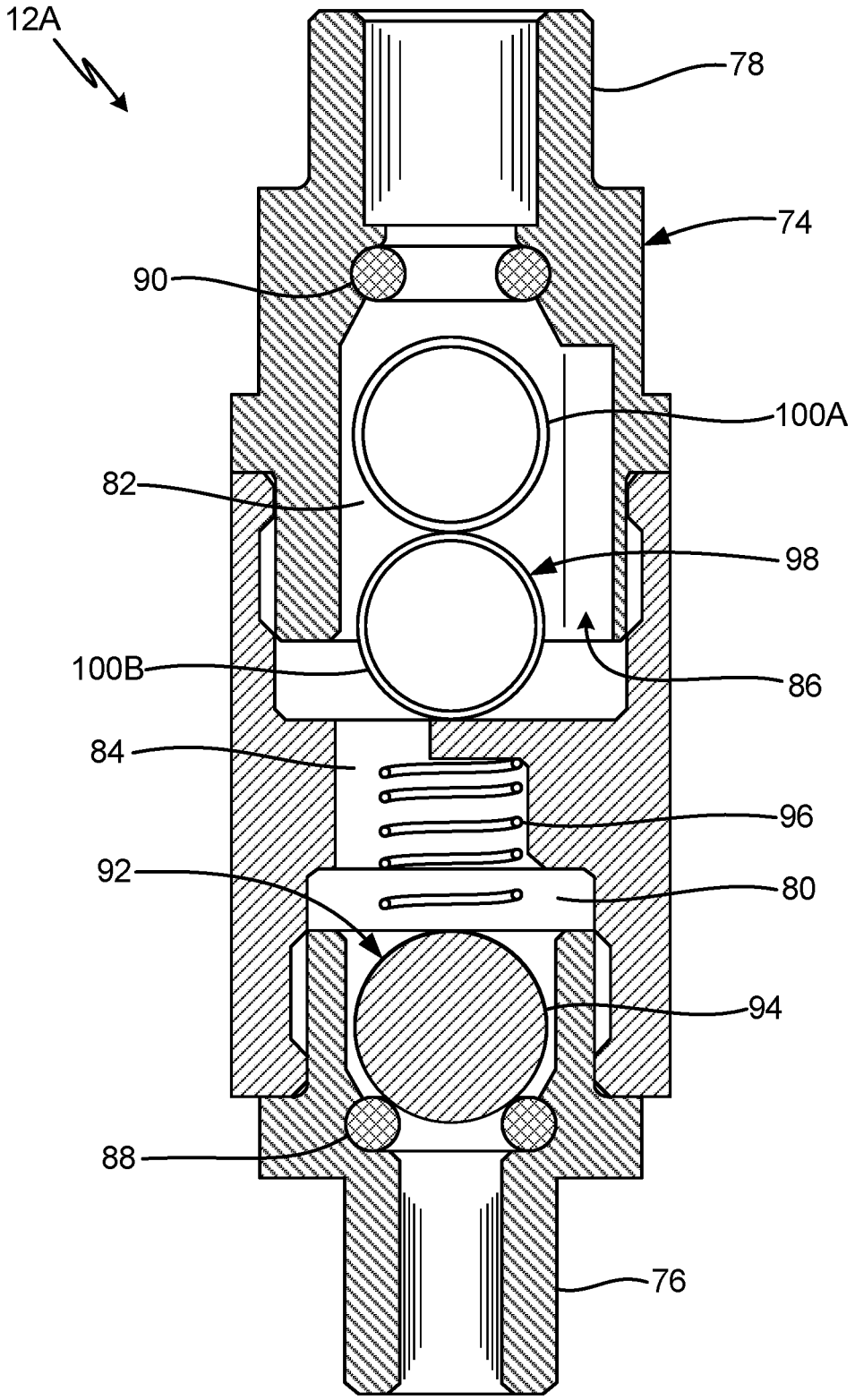
FIG. 5 is a cross-sectional view of an embodiment of the first or second breather valve.

FIG. 5 is a cross-sectional view of first breather valve 12A. First breather valve 12A and second breather valve 12B (shown in FIGS. 1 and 4A) can be identical. For simplicity, first breather valve 12A will be described, however, the description of first breather valve 12A can be directly applied to second breather valve 12B. First breather valve 12A includes valve housing 74, valve inlet 76, valve outlet 78, first chamber 80, second chamber 82, passage 84, channels 86, first valve seat 88, second valve seat 90, first valve element 92 with spring-loaded check valve element 94 and spring 96, and second valve element 98 with balls 100A and 100B.

Valve housing 74 is a generally cylindrical body of material containing first chamber 80, second chamber 82, valve inlet 76, and valve outlet 78. Valve inlet 76 and valve outlet 78 are tubular portions of solid material extending outwards from valve housing 74. Both valve inlet 76 and valve outlet 78 can include threading (not shown) or other features for fastening or attachment. First chamber 80 and second chamber 82 are compartments within valve housing 74 for the transport of fluids such as a liquid or gas. Passage 84 is a fluidic passage extending through a portion of housing 74 and fluidically connecting first chamber 80 with second chamber 82. Channels 86 are slits, cuts, or passages along and in the wall of second chamber 82. In the embodiment of FIG. 5, first valve seat 88 and second valve seat 90 are 0-rings that provide sealing surfaces. First valve element 92 includes spring-loaded check valve element 94 and spring 96. Spring-loaded check valve element 92 is a ball valve element that is connected to or in contact with spring 96. Second valve element 98 includes balls 100A and 100B made of a buoyant material, such as plastic. In other non-limiting embodiments, second valve element 98 can include one or more hollow balls, ellipsoids, cones, cylinders, or other shapes.

As shown best in FIGS. 4A and 4B, valve inlet 76 of first breather valve 12A is attached to first external line 32A. First external line 32A is connected to first vent passage 68A such that valve inlet 76 is fluidically connected to first air cavity 38A via first external line 32A and first vent passage 68A. First chamber 80 contains first valve element 92 and first valve seat 88 and is fluidly connected to valve inlet 76 and to second chamber 82. Second chamber 82 contains second valve element 98 and second valve seat 90 and is fluidly connected to valve outlet 78 and to first chamber 80. Passage 84 fluidly connects first chamber 80 and second chamber 82. Channels 86 extend along a portion of the wall of second chamber 82. First valve seat 88 is positioned at an end of first chamber 80 that is opposite from second chamber 82 and is at least partly disposed in housing 74 between inlet 76 and first valve element 92. First valve seat 88 includes a shape configured to create a seal with first valve element 92 when first valve element 92 comes into contact with first valve seat 88.

Second valve seat 90 is positioned at an end of second chamber 82 that is opposite from first chamber 80 and is at least partly disposed in housing 74 between valve outlet 78 and second valve element 98. Second valve seat 90 includes a shape configured to create a seal with second valve element 98 when second valve element 98 comes into contact with second valve seat 90. Spring-loaded check valve element 92 is disposed in first chamber 80. Spring 96 of first valve element 92 biases spring-loaded check valve element 94 against first valve seat 88 and can be connected to housing 78 at an end of first chamber 80 opposite of first valve seat 88. Second valve element 98 is disposed in and contained within second chamber 82 such that second valve element 98 is able to move freely within second chamber 82. Second valve element 98 is centered in second chamber 82 by housing 74.

First breather valve 12A is configured to allow air to leave first air cavity 58A via first vent passage 68A and first external line 32A and travel past spring-loaded check valve element 94 while also preventing fluid from entering into first air cavity 58A through first breather valve 12A. First valve element 92 with spring-loaded check valve element 94 is also designed to let any pressure out of first air cavity 58A that is substantially above atmospheric pressure to ensure first air cavity 58A does not get pressurized during the normal cycling of positive displacement pump 10. Maintaining first air cavity 58A at atmospheric pressure helps reduce strain and wear on first diaphragm 40A, thereby increasing the operating life of first diaphragm 40A. This same principle also applies to second air cavity 58B and second diaphragm 40B.

Second valve element 98 is used to allow low density fluids such as air to escape from first breather valve 12A, but in the case of the working liquid F entering first air cavity 58A and reaching first breather valve 12A after rupture R of first diaphragm 40A, second valve element 98 floats in the working liquid F, thereby pressing second valve element 98 against second valve seat 90. Flow of working liquid inside first breather valve 12A is thereby shut off and the working fluid F is not allowed to escape positive displacement pump 10. However, since second valve element 98 is only lifted by a fluid that is denser then second valve element 98, second valve element 98 only checks or closes when there is a liquid present in second chamber 82. This configuration allows spring-loaded check valve element 94 in first chamber 80 to let air out of first air cavity 58A during normal operation of positive displacement pump 10 while second valve element 98 prevents the working liquid F from escaping first breather valve 12A in the event of a failure of first diaphragm 40A.

In one non-limiting embodiment, second valve element 98 of first breather valve 12A can include two hollow plastic balls such as balls 100A and 100B. In other non-limiting embodiments, the quantity, size, shape, and material of second valve element 98 can be selected to provide for desired buoyancy and flow characteristics. One of the aspects of hollow plastic balls is that by design, they are very light so they can float and seal first breather valve 12A when working liquid F is present inside first breather valve 12A. To prevent flowing air from also lifting balls 100A and 100B up and into contact against second valve seat 90, channels 86 in housing 74 give air a path around second valve element 98 while still keeping second valve element 98 centered in housing 78. Channels 86 provide passages for air to pass by and/or around second valve element 98.

Figure 6:
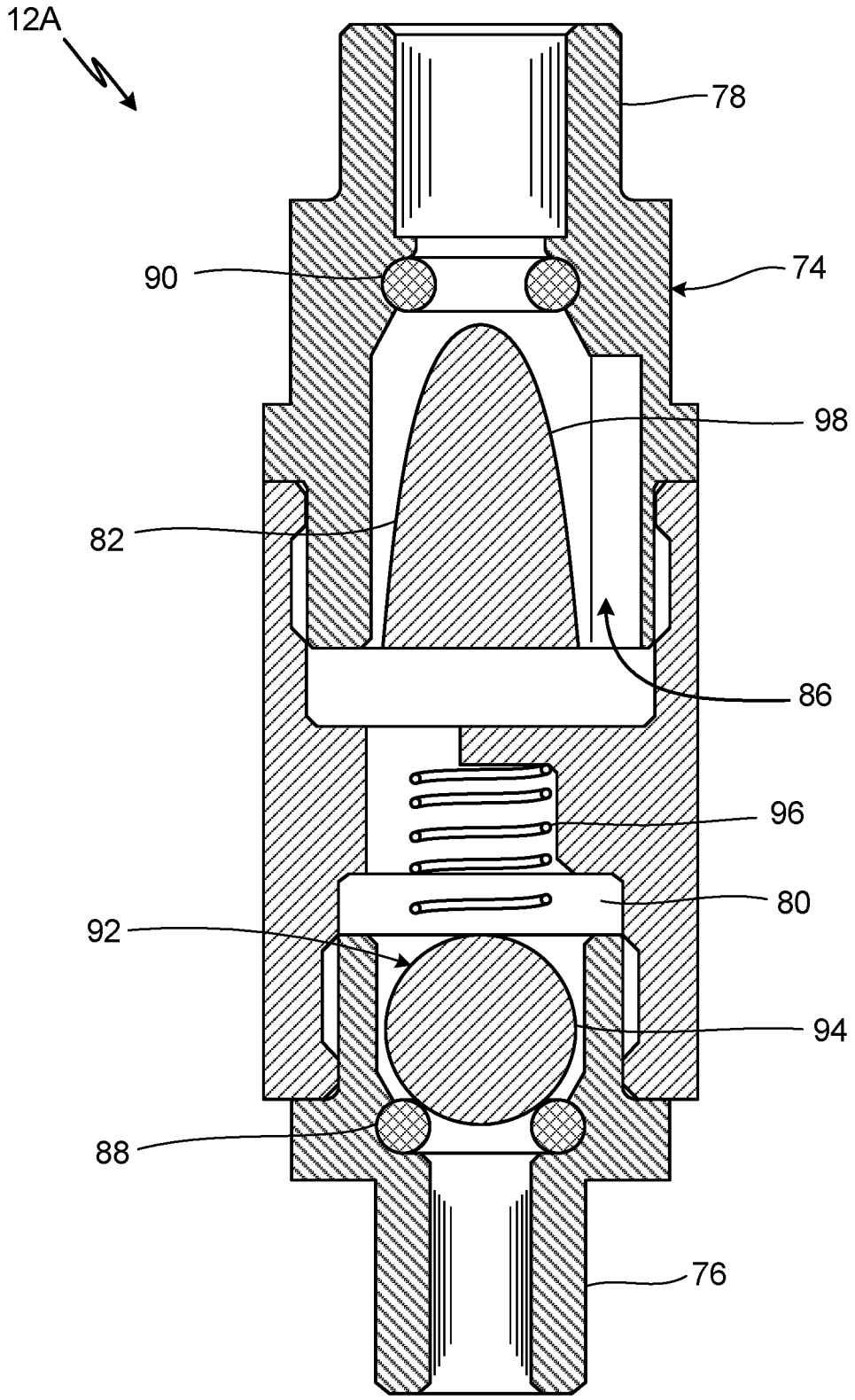
FIG. 6 is a cross-sectional view of another embodiment of the first and second breather valves with a conical valve element.

FIG. 6 is a cross-sectional view of an alternative embodiment of first breather valve 12A and/or second breather valve 12B featuring second valve element 98 with a conical geometry. Similar to the embodiment of FIG. 5, the conical geometry of second valve element 98 includes a buoyant material. A top end of second valve element 98 includes a shape configured to engage with second valve seat 90 creating a seal preventing the transfer of liquid from second chamber 82 and out of first breather valve 12A. Similar to the embodiment of first breather valve 12A discussed above with respect to FIG. 5, valve housing 78 includes channels 86 in second chamber 82 to allow air to pass by and/or around second valve element 98, thereby preventing air passing through second chamber 82 from lifting second valve element 98 and closing first breather valve 12A.

While the invention has been described with reference to an exemplary embodiment(s), it will be understood by those skilled in the art that various changes may be made and equivalents may be substituted for elements thereof without departing from the scope of the invention. For example, while FIGS. 1-4B disclose positive displacement pump 10 with first breather valve 12A and second breather valve 12B, another embodiment of displacement pump 10 can include a single breather valve 12 with a T-shaped external line 32 connecting the single breather valve 12 to both first air cavity 58A and second air cavity 58B. In addition, many modifications may be made to adapt a particular situation or material to the teachings of the invention without departing from the essential scope thereof. For example, while FIGS. 1-4B disclose positive displacement pump 10 with air motor piston 36, air motor chamber 34, and air valve 26, another embodiment of positive displacement pump 10 can include an electric motor disposed in a chamber similar to air motor chamber that is fluidically disconnected from first air cavity 58A and second air cavity 58B. The electric motor can be coupled to first shaft 46 and second shaft 48 (or to a single shaft) to actuate first diaphragm 40A and second diaphragm 40B. In another embodiment, a hydraulically driven piston can be used in place of air motor piston 36. Therefore, it is intended that the invention not be limited to the particular embodiment(s) disclosed, but that the invention will include all embodiments falling within the scope of the appended claims.

The invention claimed is:

1. A positive displacement pump configured to pump a working fluid, the positive displacement pump comprising:
- a housing surrounding a drive chamber and a diaphragm compartment;
- a drive element inside the drive chamber;
- a diaphragm inside the diaphragm compartment and dividing the diaphragm compartment into a fluid chamber and a cavity, wherein the cavity is fluidically disconnected from the drive chamber;
- a shaft connecting the drive element and the diaphragm;
- a breather valve fluidically connected to the cavity and configured to allow air to exit the cavity;
- a passage extending through the housing to the cavity; and
- a line external to the housing and fluidically connecting the passage and the breather valve, and wherein the breather valve comprises:
- a second housing with an inlet and an outlet, and wherein the inlet is fluidically connected to the cavity by the line external to the housing;
- a first chamber within the second housing, the first chamber with a first valve seat and fluidly connected to the inlet;
- a second chamber within the second housing, the second chamber with a second valve seat and fluidly connected to the outlet and the first chamber;
- a first valve element in the first chamber, wherein the first valve element comprises a spring-loaded check valve element; and
- a second valve element disposed in the second chamber, wherein the second valve element is positively buoyant relative the working fluid.

2. The positive displacement pump of claim 1, wherein the drive element comprises an air piston.

3. The positive displacement pump of claim 1, wherein the second chamber comprises channels extending into the second housing for transmission of a gas past the second valve element.

4. The positive displacement pump of claim 1, wherein the breather valve further comprising a spring located in the first chamber, and wherein the spring is in contact with the second housing and biases the first valve element against the first valve seat.

5. The positive displacement pump of claim 1, wherein the second valve element comprises a hollow plastic ball, hollow cone, hollow ellipsoid, or hollow cylinder.

6. The positive displacement pump of claim 1 further comprising:

a second diaphragm compartment formed inside the housing;

a second diaphragm inside the second diaphragm compartment and dividing the second diaphragm compartment into a second fluid chamber and a second cavity; and a second shaft connecting the drive element and the second diaphragm, and wherein the second cavity is fluidically disconnected from the drive chamber.

7. The positive displacement pump of claim 6 further comprising:

a second breather valve fluidically connected to the second cavity and configured to allow air to exit the second cavity.

8. The positive displacement pump of claim 6 further comprising:

a first seal around the shaft and between the shaft and the housing and configured to prevent fluid transmission from the diaphragm compartment to the drive chamber; and a second seal around the second shaft and between the second shaft and the housing and configured to prevent fluid transmission from the second diaphragm compartment to the drive chamber.

9. The positive displacement pump of claim 1, wherein the drive element comprises an electric motor disposed inside the drive chamber.

10. A dual diaphragm pump comprising:

a housing surrounding an air motor chamber, a first diaphragm compartment, and a second diaphragm compartment;

a piston inside the air motor chamber;

a first diaphragm inside the first diaphragm compartment and dividing the first diaphragm compartment into a first fluid chamber and a first air cavity;

a second diaphragm inside the second diaphragm compartment and dividing the second diaphragm compartment into a second fluid chamber and a second air cavity, wherein the first air cavity and the second air cavity are fluidically disconnected from the air motor chamber;

a first shaft connecting the piston and the first diaphragm;

a second shaft connected to the piston opposite the first shaft, wherein the second shaft connects the piston and the second diaphragm;

a passage extending through the housing to the first air cavity;

a breather valve fluidically connected to the first air cavity and configured to allow air to exit the first air cavity; and a line external to the housing and fluidically connecting the passage and the breather valve, and wherein the breather valve comprises:

a valve housing with an inlet and an outlet, and wherein the inlet is fluidically connected to the first air cavity;

a first chamber within the valve housing, wherein the first chamber is fluidly connected to the inlet and comprises a first valve seat;

a second chamber within the valve housing, wherein the second chamber comprises a second valve seat and is fluidly connected to the outlet and the first chamber;

a first valve element in the first chamber, wherein the first valve element comprises a spring-loaded check valve element; and a second valve element disposed in the second chamber, wherein the second valve element is hollow.

11. The dual diaphragm pump of claim 10 further comprising:

a second breather valve fluidically connected to the second air cavity and configured to allow air to exit the second air cavity.

12. The dual diaphragm pump of claim 10, wherein the second chamber comprises channels extending into the valve housing for transmission of a gas past the second valve element.

13. The dual diaphragm pump of claim 10, wherein the breather valve further comprising a spring located in the first chamber, and wherein the spring is in contact with the valve housing and biases the first valve element against the first valve seat.

14. The dual diaphragm pump of claim 10, wherein the second valve element comprises a hollow plastic ball.

15. The dual diaphragm pump of claim 10, wherein the second valve element comprises a hollow cone, hollow ellipsoid, or hollow cylinder.

16. The dual diaphragm pump of claim 10, wherein the line is transparent.

17. A positive displacement pump configured to pump a working fluid, the positive displacement pump comprising:

a housing surrounding a drive chamber and a diaphragm compartment;

a drive element inside the drive chamber;

a diaphragm inside the diaphragm compartment and dividing the diaphragm compartment into a fluid chamber and a cavity, wherein the cavity is fluidically disconnected from the drive chamber;

a shaft connecting the drive element and the diaphragm;

a breather valve fluidically connected to the cavity and configured to allow air to exit the cavity;

a passage extending through the housing to the cavity; and a line external to the housing and fluidically connecting the passage and the breather valve, and wherein the breather valve comprises:

a valve housing with an inlet and an outlet, and wherein the inlet is fluidically connected to the cavity;

a valve chamber within the valve housing, the valve chamber with a valve seat and being fluidly connected to the outlet; and a valve element disposed in the valve chamber, wherein the valve element is positively buoyant relative the working fluid.

* * * * *